United States Patent [19]

Nayar

[11] 3,996,047

[45] * Dec. 7, 1976

[54] METHOD AND MOLD FOR PRODUCING ROUND RODS BY POWDER METALLURGY

[75] Inventor: Harbhajan S. Nayar, Plainfield, N.J.

[73] Assignee: Airco, Inc., Montvale, N.J.

[ * ] Notice: The portion of the term of this patent subsequent to Jan. 14, 1992, has been disclaimed.

[22] Filed: Mar. 7, 1974

[21] Appl. No.: 449,114

[52] U.S. Cl. ..... 75/200; 75/208 R; 75/221; 75/223; 219/145

[51] Int. Cl.[2] ..... B22F 3/00; B22F 3/10

[58] Field of Search ..... 75/200, 208 R, 221, 75/223; 219/145

[56] References Cited

UNITED STATES PATENTS

| | | | |
|---|---|---|---|
| 2,155,651 | 4/1939 | Goetzel | 75/200 |
| 2,213,523 | 9/1940 | Jones et al. | 29/182 |
| 2,287,251 | 6/1942 | Jones | 75/200 |
| 3,183,086 | 5/1965 | Kurtz et al. | 75/221 |
| 3,293,006 | 12/1966 | Bartz | 75/221 |
| 3,301,671 | 1/1967 | Storchheim | 75/200 |
| 3,356,495 | 12/1967 | Zima et al. | 75/221 |
| 3,573,903 | 4/1971 | Delgrosso | 75/221 |
| 3,645,728 | 2/1972 | Hrinevich, Jr. et al. | 75/223 |
| 3,860,420 | 1/1975 | Nayar | 75/200 |

*Primary Examiner*—Brooks H. Hunt
*Attorney, Agent, or Firm*—David L. Rae; H. Hume Mathews; Edmund W. Bopp

[57] ABSTRACT

Dense round rods are obtained by placing an uncompacted particle mass into a mold containing a cavity of a predetermined geometry. The particle mass is subjected to a heating schedule wherein entrapped gases are permitted to pass off during an initial period of the schedule and during a second period of the schedule at least 75% liquid phase is formed, whereby surface tension forces cause the particle mass top portion to attain a hemispherical shape. The heated mass is permitted to cool and a round product is obtained.

1 Claim, 5 Drawing Figures

METHOD AND MOLD FOR PRODUCING ROUND RODS BY POWDER METALLURGY

BACKGROUND OF THE INVENTION

1. Field of the Invention

This invention relates generally to a method and mold for producing round metallic stock, and more specifically to a method and mold for producing round rods for use as consumable welding electrodes from an uncompacted particle mass.

2. Description of the Prior Art

Generally speaking, consumable welding electrodes of lowalloy carbon steel composition are obtained from rod stock that has received a coating of flux. Such stock is produced by casting a melt, forming billets and hot rolling the billets on a rod mill into rods. Depending upon the desired electrode diameter the rod may be used in this form or converted to smaller diameters in any conventional manner. This process is suitable for economically producing large quantities of such electrodes for welding lowalloy carbon steel stock. Many product forms, however, are fabricated from stainless steels, super alloys and cast irons. To weld these products high alloy and cast-iron electrodes are required.

Some alloy and cast-iron welding electrodes can be obtained from rods produced by casting into sand mold cavities. Typically a melt of a specific composition is prepared and poured into a mold. Although this technique can produce generally satisfactory electrodes in diameters larger than ½ inch the process has several deficiencies.

The process is expensive because sand molds can only be used once; rod size is limited by casting; gates and risers generate scrap; and compositions amenable to casting are limited. Furthermore, a portion of the mold sand usually adheres to the cast product requiring some reconditioning by grinding.

Alloy and cast-iron welding electrodes are also produced by chill molding wherein permanent molds obtained from rods are employed. Although contamination of the cast product has been eliminated this technique is limited by the compositions which can be conveniently and economically cast.

In the past welding electrodes have also been manufactured through the use of powder metallurgy. One such technique is disclosed in U.S. Pat. No. 3,650,736 wherein powders are mixed together with a binder and compacted in a mold under pressure. The compact is therefore sintered at an elevated temperature. This process requires the use of non-contaminating, expendable binders and compaction prior to sintering.

In my U.S. Pat. No. 3,860,420 filed June 18, 1973 I disclosed a powder metallurgy method for manufacturing rods for welding electrodes without employing compaction or binding agents. A particle mass is poured into a mold cavity and heated in a protective atmosphere according to a predetermined heating schedule. As used herein particle mass is defined as a single pre-alloy powder or combination of powders formulated to yield metallic stock of a specific alloy composition, homogeneity level and purity level.

Although the process disclosed in this patent produces satisfactory rods from a metallurgical standpoint, that is, uniformity of composition and structure the rod cross-section, for some applications is objectionable, in that it is not round. Round rods for welding electrodes are desirable because they can be easily coated with welding fluxes and furthermore proper electrical contact is insured when they are clamped into a welding power source.

The present invention produces substantially round rods for welding electrodes by powder metallurgy without the employment of binders or compaction prior to sintering.

SUMMARY OF THE INVENTION

In accordance with the teachings of the present invention, a method and mold are provided for obtaining round rods for welding electrodes by powder metallurgy. A mold which is essentially non-wettable and non-reactive to the composition to be contained therein is provided with a cavity of a predetermined geometry. The configuration of this cavity is such that upon completion of all the steps of this invention a substantially round rod is obtained. An uncompacted particle mass is placed into the mold cavity and then sintered in a protective atmosphere according to a specific heating schedule.

During the first stage of this heating schedule entrapped gases are permitted to escape. This is essential in order to obtain a highly densified product. During a second stage at least 75% liquid phase is formed and surface tension forces cause the particle mass top portion to attain a hemispherical shape. The product is thereafter cooled and a round product is obtained. The combination of mold cavity geometry and surface tension forces therefore create round rods in all practical diameters.

It is an object of this invention to provide a method for producing round rods by powder metallurgy.

Another object of this invention is to provide a method for producing round rods for welding electrodes from an uncompacted particle mass without employing binding agents.

A further object of this invention is to provide a method for producing round, highly dense rods for welding electrodes from an uncompacted particle mass.

Still a further object of this invention is to provide a mold containing a cavity of a pedetermined geometry for producing round rods.

DESCRIPTION OF THE PREFERRED EMBODIMENT

The method of this invention employs a mold composed of materials that will not react nor be wetted by the particle mass placed therein during the sintering operation. A non-reactive or neutral mold is essential in order to insure removal of the cast product after sintering. Furthermore, contamination of the molded product is prevented by avoiding any reaction between the particle mass and mold at sintering temperatures. As will be discussed hereinafter in greater detail surface tension forces play a significant role in producing round rods and for this reason the mold cavity must not be wetted by the particle mass when it is converted to the liquid state.

Figure 1:
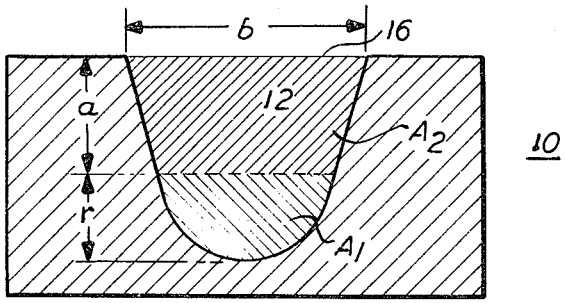
FIG. 1 shows in cross-section a mold with a cavity of a predetermined geometrical configuration.

This non-reactive, non-wettable mold is provided with a cavity of a predetermined geometric configuration. As shown in FIG. 1 a mold 10 composed of a non-reactive, non-wettable material such as graphite is provided with cavity 12. As used herein graphite is defined as extruded or molded graphite shapes or graphite plus carbon shapes in the density range of from 1.6 to 1.9 gm per cc. For purposes of this discussion this cavity consists of an upper portion $A_2$, a lower portion $A_1$, and length 1 (not shown). The relationship between $A_2$ and $A_1$ controls the amount of powder that will be placed into the mold cavity. That is, in order to obtain a round rod of a particular diameter a precise amount of powder must be placed into the cavity.

Qualitatively speaking, portion $A_1$ represents the lower segment of a finished rod whereas portion $A_2$ represents the upper segment. The larger volume defined by portion $A_2$ is required because of shrinkage which occurs during sintering.

The amount of powder that must be placed into the cavity in order to obtain a round rod can be determined by the relationship between portions $A_2$ and $A_1$. The relationship between these portions can be mathematically explained as follows:

(1) $A_1$ represents the cross-sectional area of mold cavity 12 bottom portion or $\pi r^2/2$ where $r$ equals the radius of this portion or essentially the radius of a sintered rod.

(2) $A_2$ represents the cross-sectional area of mold cavity 12 top portion, defined by $a$ and $b$, the cross-sectional dimensions of this portion.

$$\pi r^2 \frac{(ZY)}{X} = \frac{\pi r^2}{2} + \frac{a}{2}[b + 2r] = A_1 + A_2 \qquad (3)$$

or $$\frac{A_2}{A_1} = \frac{2ZY - X}{X}$$

X is a factor showing the ratio between the fill density of the powder placed into mod cavity 12, and the theoretical density of the material being sintered, this ratio can range from 0.45 to 0.70.

Y is a factor showing the ratio between density of the sintered rod and the theoretical density of the material being sintered, this ratio can range from 0.85 to 1.0.

Z is a factor showing the ratio between the length of the sintered rod and the length of the mold cavity, this ratio is generally about 0.85 to 0.95.

By substituting the following typical numerical values for X, Y and Z a typical $A_2/A_1$, ratio can be determined. Wherein $x = 0.6$; $Y = 0.95$ and $Z = 0.9$, $A_2/A_1 = 1.85$.

Thus for these typical values by placing 1.85 times more powder in the upper portion of the mold cavity than is placed in the lower portion an essentially round rod with a specific diameter will be obtained. The ratio between $A_2$ and $A_1$ should generally be in the broad range from about 1.5 to about 5.0 with a preferred range of from about 1.7 to about 2.5.

From the foregoing equations, it can be shown that $A_2$ is dependent upon the fill density of the particle mass, the desired density and final diameter of the rod, and the surface tension forces between the liquid mass, furnace temperature and atmosphere and mold material.

The relationship between $A_2$ and $A_1$ as described with reference to FIG. 1 is also applicable to the mold cavity geometry shown in FIGS. 4 and 5.

After determining the mold cavity geometry such a cavity can be provided in an essentially non-reactive and non-wettable material such as graphite. A graphite mold can be machined from stock or molded. Economics govern the manner in which a mold may be manufactured.

Depending upon the dimensions of mold cavity 12 a predetermined amount of a particle mass 14 is placed into the cavity. The particle mass is not compacted nor are any binders added thereto. Portion $A_2$ can be levelled in order to remove any excess powder.

The mold, after filling, is then placed into a furnace containing a protective or reducing atmosphere and sintered according to a specific heating schedule. During an initial stage the charge is gradually heated close to the solidus or eutectic temperature of the particle mass for about 0.1 hour to about one hour. The density of the particle mass increases from an initial fill density of approximately 55% to approximately 75 – 85%. At this density some vestiges of interconnected porosity remain. As sintering proceeds, according to the heating schedule, such elements as carbon, oxygen, sulfur and nitrogen interact, form gases and exit from the particle mass through the porous network into the furnace atmosphere. In order to achieve a higher density product sufficient time must be provided during this initial stage of the sintering in order for reaction and evolution of all gaseous products.

During the second stage of the heating schedule, the temperature is gradually increased to above the solidus or eutectic temperature of the particle mass. As the temperature increases the amount of liquid phase formed also increases. At the start of this stage about 10% liquid phase is present and at the conclusion of the heating schedule there is more than 75% liquid phase present. As the amount of liquid phase increases various dimensional and cross-sectional changes of the partially sintered particle mass take place.

As the amount of liquid phase increases to about 30% the length, width, thickness and bottom radius dimensions decrease whereas the density of the partially sintered particle mass increases to about 80 – 90% of the theoretical density. During this period the general configuration of the sintered mass is essentially similar to the mold cavity configuration. When the amount of liquid phase increases from about 30% to about 50% upper surface 16 starts to assume a convex shape as surface tension forces start to take effect on this portion of material. The length, width and bottom radius of the sintered mass have stopped decreasing whereas the thicknes is still decreasing. This is due to the particle mass gradually settling down in the mold cavity under its own gravity. The overall density of the sintered mass increases to about 85 – 95% of the theoretical density.

When the amount of liquid phase increases to about 50 – 75% the convex shape of upper surface 16 becomes more spherical and the length, width and bottom radius of the sintered mass begin to increase whereas the thickness is stll decreasing. The density of the sintered mass is well over 90% of the theoretical density and the radius of the mass begins to approach the radius r.

As the amount of liquid phase increases to more than about 75% the upper portion of the sintered mass is semi-spherical because of surface tension forces. The lower portion of the sintered mass is also semi-spherical because it has settled down under gravity forces and completely fills the round portion of $A_1$ in the mold cavity. For all practical purposes, the sintered mass is entirely round and has a density of well above 90%. Upon cooling to ambient temperature the sintered product retains a round cross-section.

Attention is now directed to the Figures for a further understanding of the method of this invention.

Figure 3:
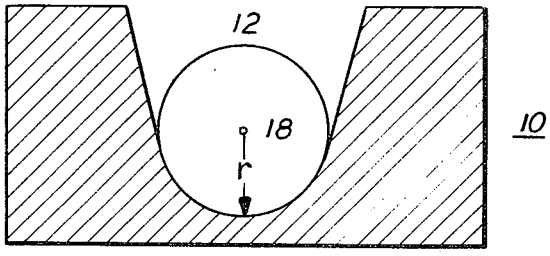
FIG. 3 shows the mold of FIG. 1 containing a sintered round rod.

FIG. 1 shows one embodiment of a mold design capable of providing a round rod. Portion $A_1$ can be considered to be essentially the bottom segment of a round rod with a radius *r*. Depending upon the solidification characteristics of different particle masses the actual solidified rod diameter may be less two times *r*, primarily because of contraction upon cooling. As shown in FIG. 3, *r* represents the radius of a solidified rod 18. As hereinbefore described $A_1 + A_2$ times the mold length represents the volume of the particle mass required for the solidified rod.

Figure 2:
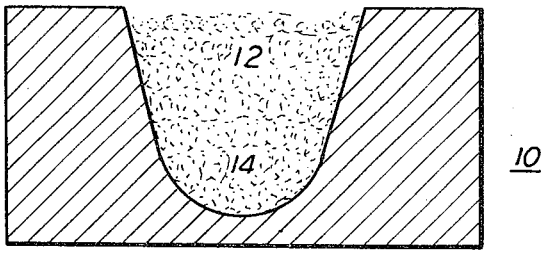
FIG. 2 shows the mold of FIG. 1 containing an unsintered particle mass.

FIG. 2 shows the mold of FIG. 1 containing a predetermined amount of particle mass 14.

FIG. 3 shows the particle mass of FIG. 2 after completion of a heating schedule as a round sintered rod 18.

Figure 4:
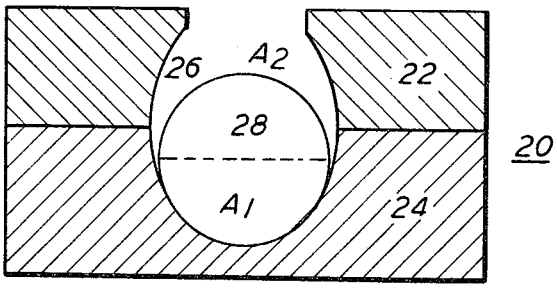
FIG. 4 shows in cross-section a split mold containing a cavity of a different geometric configuration.
Figure 5:
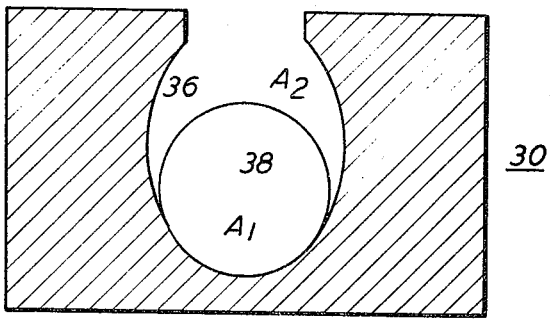
FIG. 5 shows in cross section the mold cavity of FIG. 4 wherein the mold is a single unit.

FIGS. 4 and 5 show other mold embodiments 20 and 30 that utilize a different cavity configuration 26 and 36. In both designs 26 and 36 the parameters *r*, $A_1$ and $A_2$ are the same as described for design 12 shown in FIG. 1. These designs can be employed for producing round rods from particle masses that exhibit different shrinkage characteristics. It is believed that these designs may enhance roundness in the sintered product.

As previously described graphite is desirable material for mold for construction. However, some metals when molten may wet graphite. If this occurs, surface tension would be affected and the opportunity of achieving round rods would diminish.

If a particle mass, when molten, will wet graphite then a mold 20 as shown in FIG. 4 may be employed. Mold 20 is split horizontally in half and consists of an upper metallic portion 22 and a lower graphite portion 24. By substituting an inert material such as $Al_2O_3$, BN—$TiB_2$ for graphite in the upper portion, where surface tension forces significantly affect product shape, the detrimental effect of the particle mass wetting graphite will be negated.

Removal of sintered product 28 can be accomplished by removing top portion 22 from bottom portion 24 or by permitting it to slide out from the end of the mold.

FIG. 5 shows a non-reactive, non-wettable mold 30 containing cavity 36. Sintered product 38 may be removed from the end of the mold.

The interstitial level of rods produced by the method of this invention is also improved because some degree of refining occurs during initial sintering. As the heating schedule proceeds, the gaseous products formed have an opportunity to escape through a porous network in the uncompacted particle mass. The escape of these products thereby resulting in a sintered product with a higher purity level than the starting particle mass.

The following examples illustrate the method of this invention.

EXAMPLE I

Particle Mass Description
cast-iron grit particles, size 35/120 mesh
analysis C, 3.1%; Mn, 0.7%, Si, 2.8%; S, 0.018%, P, 0.47%; O, 0.050%, Fe, balance
density (tapp) 3.86 gms/cc
Mold — graphite
Cavity Geometry
length 19 inches; $r = 3/32$ inches; $a = 0.206$ inch; $b = 0.25$ inch
Mold Factors
$X = 0.529$; $Y = 0.993$; $Z = 0.895$; $A_2/A_1$ ratio = 2.36
Heating Schedule
atmosphere — disassociated ammonia
maximum temperature reached during sintering — 2100° F time at temperature approximately 8 minutes
pre-heat time approximately 10 minutes
total time of heating schedule 18 minutes
Sintered Product Data
rod almost fully round in cross-section
length = 17 inches, diameter = 0.21 inch, weight 70 grams
density (sintered) approximately 7.25 gm/cc (almost 100% dense), oxygen content 0.0326%, sulfur content 0.010%

EXAMPLE II

Particle Mass Description
same as Example I
Mold -graphite
Cavity Geometry
length 19 inches; $r = 1/16$ inches; $A = 0.147$ inch; $b = 0.188$ inch
Mold Factors
$X = 0.529$; $Y = 0.999$; $Z = 0.895$; $A_2/A_1$ ratio = 2.38
Heating Schedule
same as Example I
Sintered Product Data
rod perfectly round in cross-section
length = 17 inches, diameter 0.150 inch, weight 35.9 grams
density (sintered = 7.29 gms/cc (almost 100% dense), oxygen content 0.0350%; sulfur content 0.010%.

EXAMPLE III

Particle Mass Description
Cu-Ni base alloy powder, size -140 mesh.
analysis Ni, 47%; Si, 1.26%; P, 5.0%; Cr, 2%; B, 1.1%; Fe, 0.8%; N, 0.0022%; O, 0.2049%; C, 0.10%; Cu, balance
density (tapp) 5.05 gms/cc
Mold - graphite
Cavity Geometry
length 19½ inches; $r = 0.040$ inch; $a = 0.070$ inch; $b = 0.094$ inch
Mold Factors
$X = 0.564$; $Y = 0.980$; $Z = 0.881$; $A_2/A_1$ ratio = 2.06
Heating Schedule
atmosphere — hydrogen
maximum temperature reached during sintering — 1750° F
time at temperature approximately 10 minutes
pre-heat time approximately 10 minutes
total time of heating schedule 20 minutes
Sintered Product Data
rod was very round length = 17.187 inches diameter 0.087 inch, weight 14.6 grams
density (sintered) 8.72 gms/cc (approx. 98% dense)
carbon content 0.070%; oxygen content 0.1096%; nitrogen content 0.0011%

Occasionally a particle mass may wet and partially react with a graphite mold during sintering. These deleterious effects an be minimized by coating the mold cavity with a film of a very fine graphite powder. In the following example the reactivity and wetability of a Ni-Cr-Si-B particle mass with a graphite mold cavity was reduced by the application of a film of fine graphite powder.

EXAMPLE IV

Particle Mass Description
Ni-Cr-Si-B base alloy powder, size −100 mesh
analysis C, 0.66%; Cr, 14.20%; B, 3.0%; Si, 4.10%; Fe, 4.8%; O, 0.1011%; Ni, balance
density (tapp) 4.65 gms/cc Mold — graphite with a film of graphite deposited on the cavity Cavity Geometry
length 20 inches; $r = 1/16$ inch; $a = 0.094$ inch Heating Schedule
atmosphere — hydrogen
maximum temperature reached during sintering — 1950° F time at temperature approximately 5 minutes
pre-heat time approximately 6 minutes
total time of heating schedule 11 minutes Sintered Product Data
rod was very round
length = 19 inches, diameter 0.118 inch, weight = 30.0 grams
density (sintered) = 8.80 gms/cc (approx. 99% dense)
oxygen content = 0.0630

It is apparent from these examples that round rod with densities greater than 90% can be obtained from particle masses by following the method of this invention. Furthermore, the sintered product produced by this method has a lower oxygen, carbon, nitrogen and sulfur content than the starting particle mass.

I claim:

1. A method of producing metallic stock by powder metallurgy comprising the steps of providing a mold of predetermined geometry, introducing a particle mass into the mold cavity, heating the particle mass in said mold and allowing said particle mass to cool to form said metallic stock, the improvement comprising:

a. introducing said particle mass by placing the precise amount of uncompacted powder as said particle mass in the mold for forming a round rod of predetermined diameter; and b. heating the particle mass to sinter said mass in a first stage at approximately the solidus or eutectic temperature of said particle mass for up to about one hour to permit gaseous products to escape through an interconnected porous network and in a second stage at a temperature above the solidus or eutectic temperature of said particle mass until at least 75% liquid phase is formed with surface tension causing the top portion of said particle mass to attain a hemispherical shape substantially without vestiges of said porous network such that upon said cooling said round rod is formed.

* * * * *